US009301623B2

(12) United States Patent
Herdman

(10) Patent No.: US 9,301,623 B2
(45) Date of Patent: Apr. 5, 2016

(54) PORTABLE BABY CHANGE APPARATUS

(71) Applicant: HERDTEX PRODUCTS LTD, County Durham (GB)

(72) Inventor: George Kenneth Herdman, County Durham (GB)

(73) Assignee: HERDTEX PRODUCTS LTD, County Durham (GB)

( * ) Notice: Subject to any disclaimer, the term of this patent is extended or adjusted under 35 U.S.C. 154(b) by 0 days.

(21) Appl. No.: 14/672,581

(22) Filed: Mar. 30, 2015

(65) Prior Publication Data

US 2015/0282637 A1 Oct. 8, 2015

(30) Foreign Application Priority Data

Apr. 3, 2014 (GB) ..... 1406014.9

(51) Int. Cl.
*A47D 5/00* (2006.01)

(52) U.S. Cl.
CPC . *A47D 5/003* (2013.01); *A47D 5/00* (2013.01)

(58) Field of Classification Search
CPC ..... A47D 5/00; A47D 5/003; A47D 5/006
USPC ..... 5/655, 947; 190/2
See application file for complete search history.

(56) References Cited

U.S. PATENT DOCUMENTS 5,215,172 A * 6/1993 Stevenson ..... 190/2
6,032,310 A 3/2000 Helmsderfer et al.
6,298,509 B1 * 10/2001 Vickers ..... 5/655
6,308,641 B1 10/2001 Kingbury
6,918,147 B2 * 7/2005 Stackman et al. ..... 5/655
7,891,034 B2 * 2/2011 Smith ..... 5/655
8,677,534 B2 * 3/2014 Gant et al. ..... 5/655
8,887,335 B2 * 11/2014 Gant et al. ..... 5/655
8,973,757 B2 * 3/2015 Fimbrez ..... 206/581
2010/0138995 A1 6/2010 Smith
2013/0167299 A1 7/2013 Grant

FOREIGN PATENT DOCUMENTS

JP H07308225 11/1995

OTHER PUBLICATIONS

Combined Search Report and Examination Report from the Intellectual Property Office of Great Britain for Application No. GB1406014.9 dated Sep. 11, 2014 (8 pages).

* cited by examiner

*Primary Examiner* — Michael Trettel
(74) *Attorney, Agent, or Firm* — Michael Best & Friedrich LLP

(57) ABSTRACT

A portable baby change apparatus (10) may include a first part (20), adapted to be removably suspended from a support structure (110); a second part (30), pivotably attached to the first part (20), and providing at least a portion (32) of a surface for changing a baby; wherein the first and second parts (20, 30) are pivotable relative to each other, between a closed configuration wherein the first part (20) covers said portion (32) of said surface, and an open configuration wherein, when the first part (20) is suspended from a support structure (110), said surface (32) is substantially horizontal. Extension parts (40), coupled to the second part (30), are movable relative to the second part (30) between a first position and a second position wherein, the extension parts (40) provide further portions (42) of said surface.

23 Claims, 4 Drawing Sheets

PORTABLE BABY CHANGE APPARATUS

The present invention relates to a portable baby change apparatus, and relates particularly but not exclusively to a baby change bag comprising an integrated portable baby change unit.

Baby change bags, also known as diaper bags, generally comprise multiple compartments and pockets for storing products and accessories, such as nappies and baby wipes and the like, for caring for a baby while away from the home. Many baby change bags are also provided with a waterproof padded mat which can be removed from the bag and placed on a suitable available surface for changing the baby's nappy. However, it is not always easy to find a suitable surface. It can also be difficult to change a baby's nappy on the floor, particularly as many toilets or rest rooms are very cramped. It is often undesirable to change a baby's nappy on the floor for hygiene reasons.

Some toilets or rest rooms or dedicated baby change facilities are equipped with a baby change table. A baby change table may be hinged to a wall so that it can be folded up against the wall to save space when it is not in use. However, these are not always available.

Preferred embodiments of the present invention seek to overcome one or more of the disadvantages of the prior art.

According to a first aspect of the present invention, there is provided a portable change apparatus, comprising:

a first part, adapted to be removably suspended from a support structure;

a second part, pivotably attached to the first part and providing at least a portion of a surface for changing a baby;

wherein the first and second parts are pivotable relative to each other, between a closed configuration wherein the first part covers said portion of said surface, and an open configuration wherein, when the first part is suspended from a support structure, said surface is substantially horizontal.

Advantageously, the present invention provides a suitable surface for changing a baby, which can conveniently be carried when away from home and suspended from an available support structure, such as a door or wall, to provide a clean baby change surface at a convenient height.

In one embodiment the portable baby change apparatus further comprises at least one extension part, coupled to said second part, and moveable relative to said second part between a first position and a second position in which said extension parts provides a further portion of said surface.

Advantageously this enables the baby change apparatus to be integrated within a standard sized baby change bag so as to be compact for carrying with the or each extension part in the first position, while providing a surface which is sufficiently long for changing babies and toddlers when the or each extension part is in the second position.

Said or each extension part may be configured to extend said surface in a direction substantially parallel to an axis about which the first and second parts pivot.

In one embodiment, at least a portion of said extension part is slidably receivable in a recess or cavity of said second part.

Advantageously, this enables the extension part to be retracted from the second part while the surface is in use.

Said extension part may be coupled to said second part by at least one telescoping member for extending/retracting the extension part from/into said cavity.

Said extension part may be coupled to said second part by two spaced-apart telescoping members for extending/retracting said extension part from/into said cavity.

Advantageously, this configuration enables the telescoping members to provide a support frame for the extension parts and/or for the second part.

In another embodiment, said extension part is hingedly attached to said second part.

Said further portion of said surface may be provided by a keder insert supported by keder rails.

In embodiments in which the extension part is coupled to the second part by one or more telescoping members, the telescoping members may comprise said keder rails.

Preferably, said extension part is releasably secured in said first position by a press-release latch.

This prevents the extension part or parts from moving to the second position when the portable baby change apparatus is being transported, but enables easy deployment of the extension parts when required.

In one embodiment, the portable baby change apparatus further comprises a flexible attachment portion, attached to said first part and to at least one holding member for removably securing the baby change apparatus to a support structure.

Advantageously, a flexible attachment portion can be folded or rolled or otherwise arranged for storage, for example in a compartment of the portable baby change apparatus.

Preferably, the flexible attachment portion comprises two spaced-apart straps, each attached at one end to said first part, and a frame member extending between and secured to said straps.

Advantageously, the frame member limits the spacing between the straps and helps to prevent the straps from becoming tangled. The frame member also provides a part of the attachment portion which can be grasped by a user when deploying the attachment portion. Since the two straps are joined by the frame member, a user is able to deploy both straps in a single operation.

The flexible attachment portion may comprise webbing.

The frame member may be stitched to said straps.

The frame member may comprise plastic.

Advantageously, the above features enable the user to grasp the frame member for deploying the attachment portion more easily, since the plastic material of frame member may be selected so that the frame member is stiffer than the straps.

The frame member may comprise a thermoplastic elastomer (TPE) material.

In one embodiment, a length of said attachment portion between said holding member and said first part is adjustable.

This enables the height of the surface for changing a baby to be adjusted when the portable baby change apparatus is suspended from a support structure.

In one embodiment, said attachment portion comprises at least one strap, threaded through an aperture in said holding member and/or said first part for adjusting said length of said attachment portion, and securing means for securing a first portion of said strap located on one side of said aperture to a second portion of said strap located on the other side of said aperture.

The securing means may comprise a quick-release or cam buckle.

The holding member may comprise a hook portion for hooking over a support structure.

The holding member may comprise a clamping member for clamping to a support structure.

Advantageously, a clamping member enables the holding member to be adjusted so that it may be secured to a support structure of any thickness. When used in conjunction with a hook portion, the attachment portion may initially be hooked to a support structure, then firmly secured by fastening the clamping member around the support structure.

In one embodiment the first part further comprises a compartment for storing the flexible attachment portion.

In this way, the flexible attachment portion may be stowed when not in use.

Preferably, the portable baby change apparatus further comprises restraining means for limiting the angle through which the first and second parts pivot relative to one another.

This feature ensures that the second part is substantially horizontal when the first part is suspended from a support structure and the baby change apparatus is in the open configuration.

In one embodiment, said restraining means comprises at least one restraining member connecting said first part to said second part and/or to said attachment portion.

In another embodiment said first and second members are coupled by a hinge having a limited pivoting angle.

In one embodiment the portable baby change apparatus further comprises a handle or strap attached to said first and/or second part such that, when the baby change apparatus is suspended by the handle or strap in the closed configuration, said first and second parts are pivotably attached at a lower edge.

Advantageously this enables single handed deployment of the baby change apparatus. The baby change apparatus can be carried on a user's shoulder using the strap, from which position the flexible attachment portion can be deployed using one hand, for example by grabbing the frame member, and raised into position to hook over a support structure. The user can then let go of the baby change apparatus and can unfasten the second part from the first part and lower it into the open configuration. The baby change apparatus is then ready for use. This can all be done while carrying a baby in the other arm.

In one embodiment, the first and second parts each comprise a fabric cover, wherein the fabric cover of the first part is attached to the fabric cover of the second part along one edge, enabling the first and second parts to pivot relative to one another.

In one embodiment said first part comprises at least one pocket, arranged to be adjacent to said surface in the closed configuration.

Advantageously this enables supplies such as nappies, wipes and lotions to be stored and transported in said pocket or pockets. When the baby change apparatus is in its open configuration, said pockets and products within them are easily accessible to a user while changing a baby's nappy.

In one embodiment, in the closed configuration, said first and second parts are joinable along at least a portion of their edges to form an enclosure.

This enables items to be transported in the enclosure between the first and second parts, and prevents items stored in the pockets from falling out.

In one embodiment, said first and/or second part further comprises at least one compartment.

This provides a further compartment for transporting items.

According to a second aspect of the invention, there is provided a portable baby change apparatus, comprising:

a first part;

a second part, pivotably attached to the first part, and providing at least a first portion of a surface for changing a baby; and at least one extension part, coupled to said second part, and movable relative to said second part between first and second positions, wherein, in said second position said extension part provides a further portion of said surface;

wherein the first and second parts are pivotable relative to each other, between a closed configuration wherein the first part covers said first portion of said surface, and an open configuration.

Advantageously, the present invention provides a suitable surface for changing a baby, which can conveniently be carried when away from home to provide a clean baby change surface at a convenient height. The provision of extension parts enables the baby change apparatus to be integrated within a standard sized baby change bag so as to be compact for carrying when the or each extension part is stowed in the first position, while providing a surface which is sufficiently long for changing babies and toddlers when the or each extension part is in the second position.

Preferably, said or each extension part is configured to extend said surface in a direction substantially parallel to an axis about which the first and second parts pivot.

In one embodiment, at least a portion of said extension part is slidably receivable in a recess or cavity of said second part.

Said extension part may be coupled to said second part by at least one telescoping member for extending/retracting the extension part from/into said recess or cavity.

Said extension part may be coupled to said second part by two spaced-apart telescoping members for extending/retracting the extension part from/into said recess or cavity.

In another embodiment, said extension part is hingedly attached to said second part.

Said further portion of said surface may be provided by a keder insert supported by keder rails.

Preferably, the extension part is releasably secured in said first position by a press-release latch.

The first part may comprise at least one pocket, arranged to be adjacent to said surface in the closed configuration.

The first and second parts each comprises a fabric cover, wherein the fabric cover of the first part is attached to the fabric cover of the second part along one edge, enabling the first and second parts to pivot relative to one another.

In the closed configuration, said first and second parts may be joinable along at least a portion of their edges to form an enclosure.

Said first and/or second part may further comprise at least one compartment.

A preferred embodiment of the present invention will now be described, by way of example only and not in any limitative sense, with reference to the accompanying drawings, in which.

Figure 1:
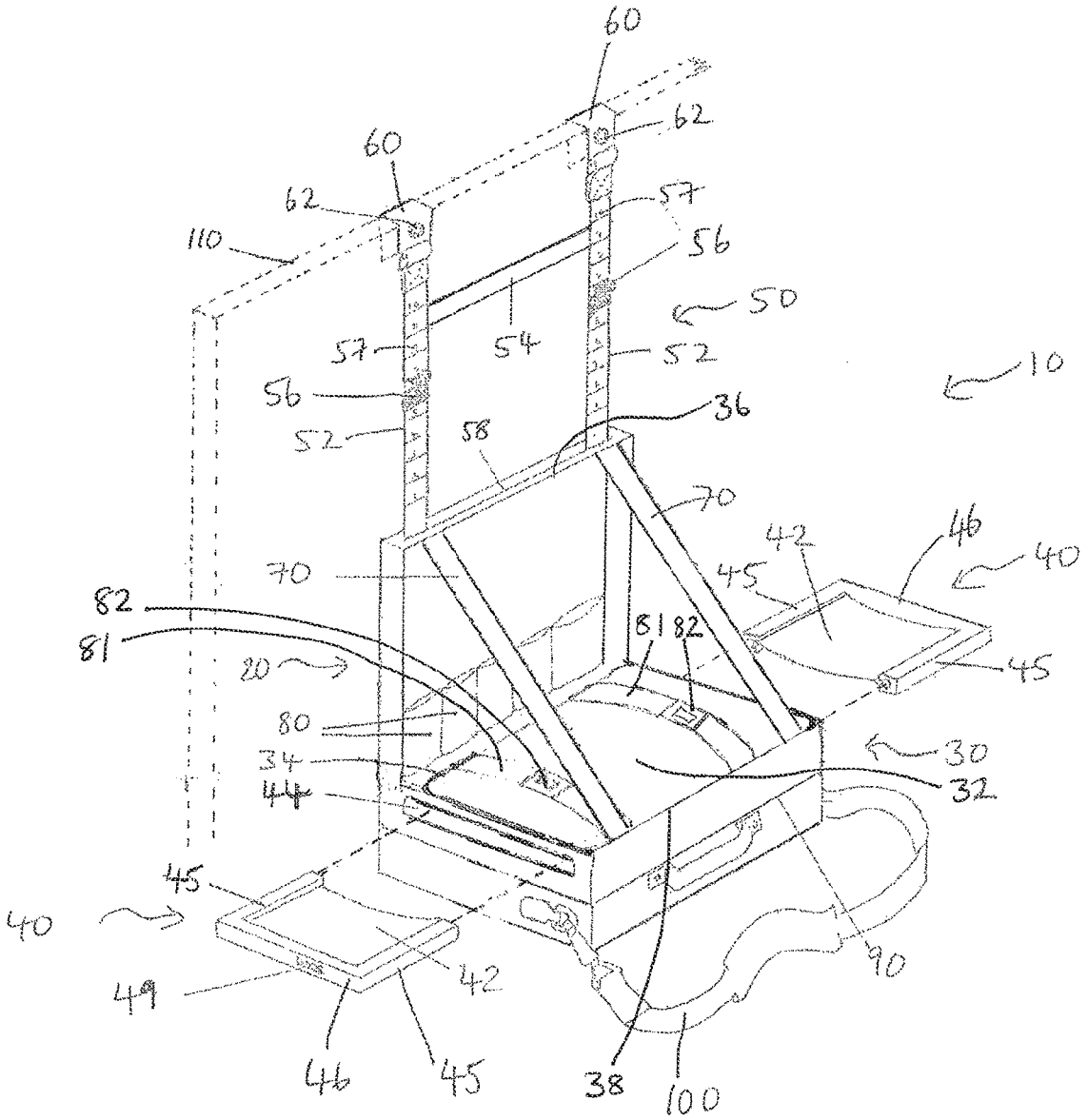
FIG. 1 illustrates a portable baby change apparatus according to a first embodiment of the present invention.
Figure 2:
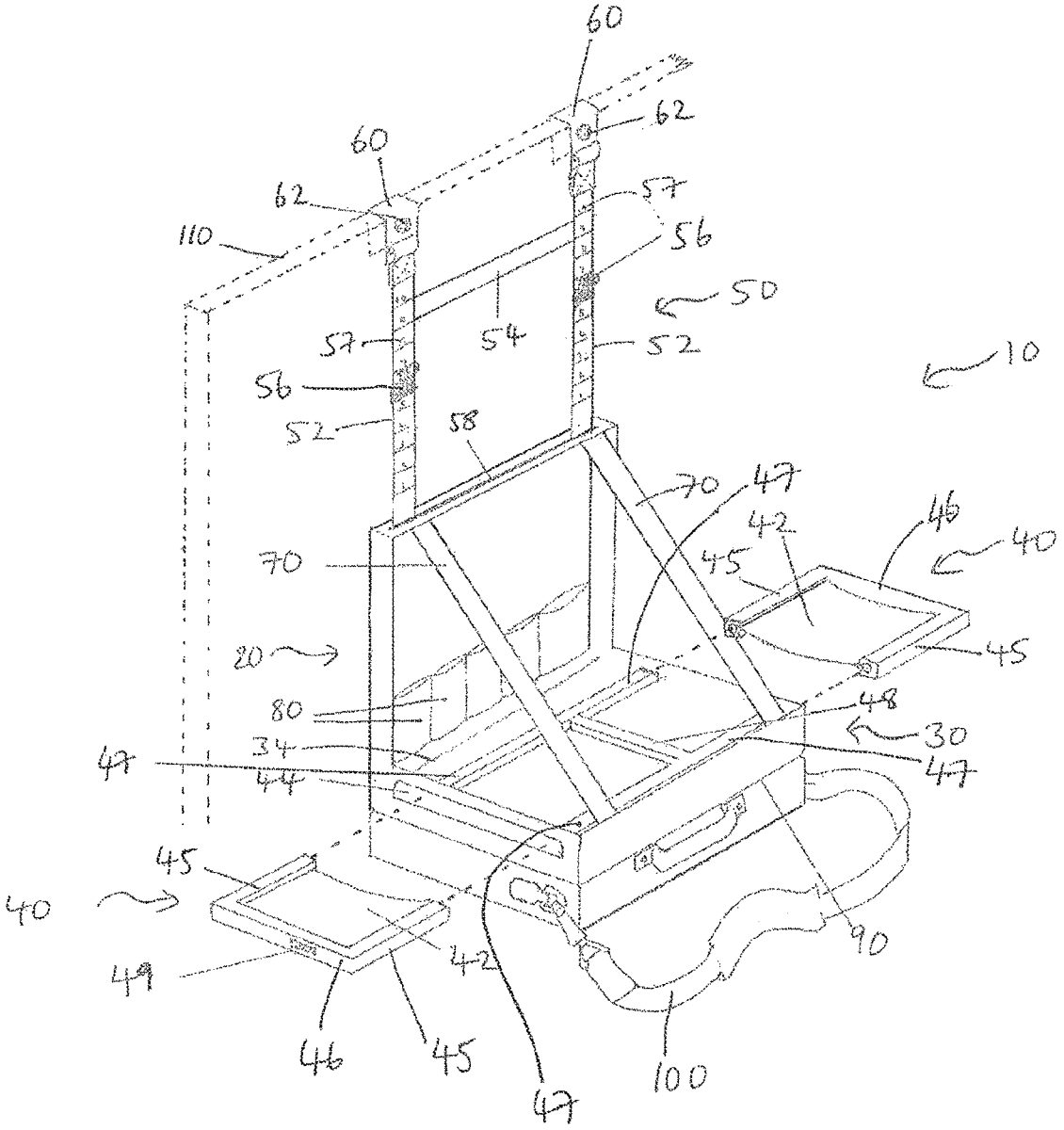
FIG. 2 illustrates the portable baby change apparatus of the first embodiment, with a cushioning surface removed to show the interior of the apparatus.

With reference to FIGS. 1 to 4, a preferred embodiment of the portable baby change apparatus 10 of the present invention will now be described. As shown in FIGS. 1 and 2, the portable baby change apparatus 10 of the first embodiment is in the form of a baby change bag comprising an integrated baby change apparatus 10. The baby change apparatus 10 comprises a first part 20 and a second part 30, pivotably attached to the first part 20 and providing a surface 32 for supporting a baby or toddler while changing his or her nappy.

The first part 20 may be removably suspended from a support structure 110, such as a door or a cubicle wall panel, by means of an attachment portion 50. The first and second parts 20, 30 are joined to each other along an edge 34 and are pivotable between a closed configuration, wherein the first part covers the surface 32, and an open configuration (as shown in FIGS. 1 and 2). The open configuration is such that, when the first part 20 is suspended from a support structure 110, with the baby change apparatus 10 in the open configuration, the surface 32 is substantially horizontal for supporting a baby.

This is achieved by means of restraining members 70, in the form of nylon webbing straps, attached at one end to the first part 20 and at the other end to the second part 30. The restraining members 70 connect the first and second parts 20, 30 and thereby limit the angle between the first and second parts 20, 30 to a maximum of around 90 degrees. However, alternative means for restricting the angle between the first and second parts 20, 30, are also envisaged. For example, in an alternative embodiment (not shown) the first and second parts 20, 30 are coupled together by a hinge having a limited angle of rotation.

The baby change apparatus 10 includes two extension parts 40 providing additional surface portions 42, for extending the area of the surface 32, 42 for supporting a baby. The extension parts 40 extend from the second part 30 in a direction transverse to that of the first part 20 in the open configuration, that is, in a direction substantially parallel to the axis 34 about which the first and second parts 20, 30 pivot. Thus the surface 32, 42 for supporting a baby comprises a central portion 32 provided by the second part 30, and lateral portions 42 provided by the extension parts 40. The surface area required for supporting a baby or toddler is generally longer than the typical length of a baby change bag. Therefore, the provision of extension parts 40 enables the overall size of the baby change bag 10 to be small enough that it can be carried comfortably, while providing an extended surface area 32, 42 when needed for supporting a baby or toddler.

Preferably the surfaces 32 and 42 comprise a waterproof material covering a foam or sponge padding. Straps 81 with fasteners 82 such as LB25 type plastic release buckles are provided for securing the baby. The straps 81 are preferably a soft material such as velour.

The extension parts 40 are moveable relative to the second part 30 between first and second positions. In the first position, the extension parts 40 are each received or stored in a respective cavity 44 of the second part 30. In the second position, the extension parts 40 protrude laterally from the second part 30 and are arranged such that their surfaces 42 and the surface 32 of the second part 30 together provide a substantially continuous surface for receiving or supporting a baby.

In this embodiment, each of the extension parts 40 are coupled to the second part 30 by two spaced-apart telescoping members 45 which enable the extension parts 40 to be extended from and retracted into the cavity 44. The two telescoping members 45 of each extension part 40 support the lateral surface portions 42 and are joined by cross-bars 46 at their ends to provide further rigidity. The telescoping members 45 are slidably received in tubular members 47 (see FIG. 2) which are fixed inside the second part 30. In this embodiment, the tubular members 47 receiving the four telescoping members 45 are provided by two double-ended tubular members 47, each receiving a telescoping member 45 coupled to one extension part 40 at one end, and receiving a telescoping member 45 coupled to the other extension part 40 at the other end. The two tubular members 47 provide support to the second part 30 of the baby change apparatus 10, in particular the central surface portion 32, and are joined together by a cross-bar 48 for additional rigidity. The telescoping members 45, cross-bars 46, tubular members 47 and cross-bar 48 preferably comprise aluminium tubing in order to minimise the weight of the baby change apparatus 10, and to provide strength to the second part 30 and extension parts 40. The tubing may have any cross-sectional shape, including rectangular as shown in FIG. 2. Preferably, the aluminium telescopic poles are provided with a press release latch 49 for releasably securing the extension parts 40 in the first position.

Figure 4:
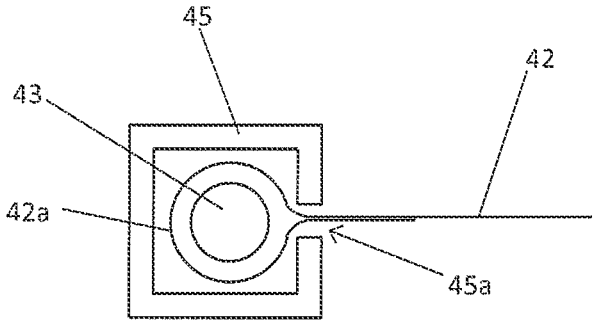
FIG. 4 is a cross-sectional view of a part of an extension part for the portable baby change apparatus of the first embodiment.

The surface 42 of each extension part 40 may be provided by an insert 42 which is supported between the telescoping members 45 and cross-bar 46 of each extension part 40. The inserts 42 may comprise, for example, nylon or PVC. In one embodiment, the inserts 42 are keder inserts 42 as shown in FIG. 4. The edges 42*a* of the inserts 42 encase a cord 43 which is received in the corresponding telescoping members 45 and optionally also in the corresponding cross-bar 46. The telescoping members 45 are hollow for receiving the cord 43, and are provided with a slot 45*a* on their inner sides through which the insert 46 passes. The tubular members 47 are also slotted so that the nylon insert 42 can extend through these slots when the extension parts 40 are retracted into the second part 30.

Although the extension parts 40 of the embodiment shown in FIGS. 1 and 2 slide into and out of cavities in the second part 30, alternative arrangements are possible, including an arrangement in which extension parts are connected to the second part 30 by hinges or similar, such that they unfold out of the second part 30 when the baby change apparatus 10 is in the open configuration.

Figure 3:
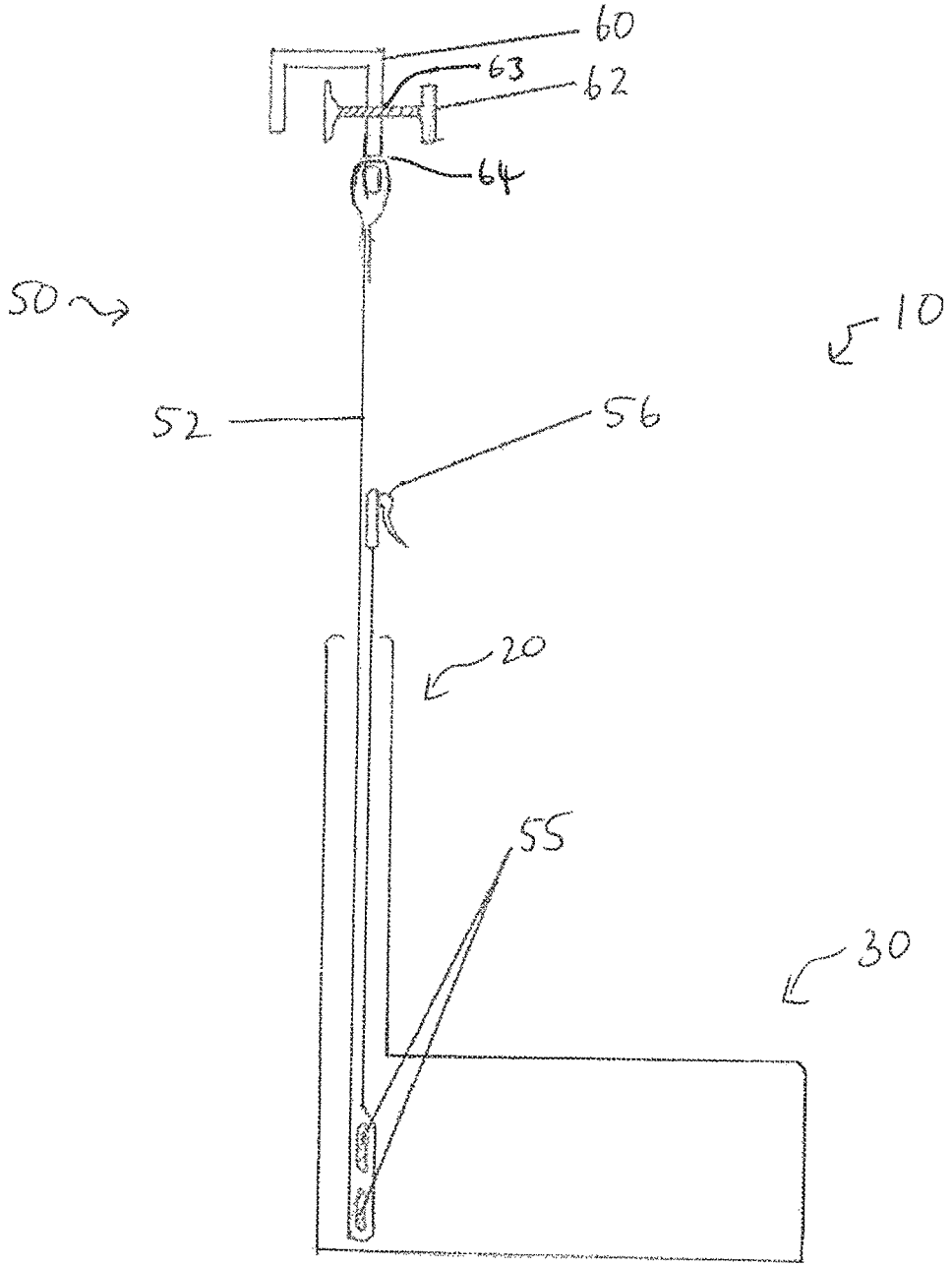
FIG. 3 is a cross-sectional view of the baby change apparatus of the first embodiment.

The flexible attachment portion 50, for suspending the the baby change apparatus 10 from a support structure 110, is attached to the first part 20 and to two holding members 60, each in the form of a hook 60. The hooks 60 can be hooked over a door or wall panel to suspend the baby change apparatus 10. The hooks 60 are preferably made of pressed steel, and may be powder coated. With reference to FIG. 3, each hook 60 is provided with a clamping member 62, in the form of a threaded bolt 62 which enables the hooks 60 to be secured to support structures 110 of various thicknesses. The threaded bolt 62 passes through a threaded hole 63 in one side of the respective hook 60, and clamps against the support structure 110. In this way, the support structure 110 is clamped between the bolt 62 and the other side of the hook 60.

The flexible attachment portion 50 comprises two spaced-apart straps 52 and a frame member 54 extending between and secured to the straps 52. The straps 52 are each attached at one end to the first part 20 and at the other end to a respective hook 60. Preferably the straps 52 comprise webbing, for example nylon webbing, having a width of, for example, around 38 mm. The frame member 54 limits the separation between the straps 52 in use. The frame member 54 may comprise a plastic material such as a sewable TPE (thermoplastic elastomer) material, although other materials may be used. The TPE frame member 54 provides sufficient rigidity to keep the straps 52 spaced apart when in use and is also useful for preventing the straps 52 from becoming tangled during storage. The frame member 54 is in the form of a rectangular bar and is securely stitched to the straps 52 at each end. Alternatively, the frame member 53 may have an 'H' shape so that it has portions extending a short distance along the straps 52 to provide extra rigidity to a short section of the straps 52 and/or a larger area for stitching to the straps 52.

The length of the attachment portion 50, i.e. the distance between the hooks 60 and the first part 20 in use, is adjustable. This enables the height of the baby change surface 32, 42 to be adjusted for convenience. The straps 52 are each fixed at one end to a respective hook 60. The hooks 60 have an aperture 64, through which the end of the strap 52 is looped and secured, by stitching or otherwise, to itself. Starting from the hook 60, each strap 52 then passes down into the first part 20, around plastic tabs 55 secured inside the first part 20, and back up out of the first part 20 to be secured to another part of the strap 52 by fastening means such as a cam buckle 56. To adjust the length of the attachment portion 50, the cam buckles 56 are released and the straps 52 are pulled further past the plastic tabs 55 in one direction or the other to shorten or lengthen the attachment portion. The straps 52 may be printed with height adjustment markers 57 so that each strap can be adjusted to the corresponding positions so that the baby change apparatus 10 is level when suspended from a support structure 110 by the hooks 60. Although cam buckles 56 are preferred, since they enable quick and continuous adjustment, other fastening means such as buckles or D rings may be used.

Since the attachment portion 50 is flexible, it can be rolled or folded for storage in a zipped compartment 56 of the first part 20. The attachment portion 50 is easily pulled out of the compartment 58 by grabbing the frame member 54. By grabbing the frame member 54, a user is able to pull out both straps 52 simultaneously.

The first part 20 is provided with several pockets 80 on an inner surface, i.e. adjacent to the surface 32 when in the closed configuration. These pockets 80 are useful for storing items such as nappies and baby wipes, so that they are easily accessible to a user when using the baby change apparatus 10. The pockets 80 are orientated with their openings upwardly facing when the baby change apparatus 10 is suspended and in the open configuration.

In this embodiment, the portable baby change apparatus 10 is in the form of a bag and the first and second parts 20, 30 may be joined along their perimeters 36, 38 by a zip closure to completely enclose the baby change surface 32 when in the closed configuration. This also prevents items stored in the pockets 80 from falling out. Preferably the zip closure is a two-way zip with closed ends adjacent the edge 34. The second part 30 comprises a further zipped compartment 90 for additional storage of items such as food, clothing etc.

The baby change apparatus 10 is provided with a handle or strap 100 attached to the second part 30. When the baby change apparatus 10 is suspended by the strap 100 and is in the closed configuration, the edge 34 along which the first and second parts are pivotably attached is a lower edge of the baby change bag.

The baby change apparatus 10 can easily be deployed using one hand, for example while carrying a baby in the other arm, as follows. By carrying the baby change apparatus 10 over a shoulder using the strap 100, a person can use their free hand to unzip the compartment 58 and pull out the attachment portion 50 and hook it over a support structure 110. The baby change apparatus 10 can then be released and the user is able to unzip the first and second parts 20, 30 from each other so that the second part 30 drops downwards into the open configuration. The user is then free to either place the baby on the surface 32 or to extend the extension parts 40 to provide a larger surface 32, 42. Everything required for changing the baby's nappy is then easily accessible in the pockets 80.

The skilled person will appreciate that the baby change apparatus 10 may also be used without being suspended from a support structure 110. The apparatus 10 may be placed on the floor or other suitable surface to provide a clean surface for supporting a baby. When used in this way, the user still obtains the advantage of a portable, compact apparatus 10 which can be extended by means of the extension parts 40 to provide a suitably large surface 32, 42 for supporting a baby or toddler, and with easy access to any babycare products or accessories stored in the pockets 80. In an alternative embodiment of the invention (not shown), the flexible attachment portion 50, or other means for suspending the apparatus from a support structure, may be omitted.

It will be appreciated by persons skilled in the art that the above embodiments have been described by way of example only, and not in any limitative sense, and that various alterations and modifications are possible without departure from the scope of the invention as defined by the appended claims.

What is claimed is:

1. A portable baby change apparatus, comprising:

a first part, adapted to be removably suspended from a support structure;

a second part, pivotably attached to the first part, and providing at least a portion of a surface for changing a baby;

wherein the first and second parts are pivotable relative to each other, between a closed configuration wherein the first part covers said portion of said surface, and an open configuration wherein, when the first part is suspended from a support structure, said surface is substantially horizontal; and further comprising at least one extension part, coupled to said second part, and movable relative to said second part between a first position and a second position in which said extension part provides a further portion of said surface.

2. A portable baby change apparatus according to claim 1, wherein said or each extension part is configured to extend said surface in a direction substantially parallel to an axis about which the first and second parts pivot.

3. A portable baby change apparatus according to claim 1, in which at least a portion of said extension part is slidably receivable in a recess or cavity of said second part.

4. A portable baby change apparatus according to claim 3, wherein said extension part is coupled to said second part by at least one telescoping member for extending/retracting the extension part from/into said recess or cavity.

5. A portable baby change apparatus according to claim 1, wherein said extension part is hingedly attached to said second part.

6. A portable baby change apparatus according to claim 1, wherein said further portion of said surface is provided by a keder insert supported by keder rails.

7. A portable baby change apparatus according to claim 1, wherein said extension part is releasably secured in said first position by a press-release latch.

8. A portable baby change apparatus according to claim 1, further comprising a flexible attachment portion, attached to said first part and to at least one holding member for removably suspending the baby change apparatus from a support structure.

9. A portable baby change apparatus according to claim 8, wherein the flexible attachment portion comprises two spaced-apart straps, each attached at one end to said first part, and a frame member extending between and secured to said straps.

10. A portable baby change apparatus according to claim 8, wherein a length of said attachment portion between said holding member and said first part, is adjustable.

11. A portable baby change apparatus according to claim 10, wherein said attachment portion comprises at least one strap, threaded through an aperture in said holding member and/or said first part for adjusting said length of said attachment portion, and securing means for securing a first portion of said strap located on one side of said aperture to a second portion of said strap located on the other side of said aperture.

12. A portable baby change apparatus according to claim 11, wherein said securing means comprises a quick-release or cam buckle.

13. A portable baby change apparatus according to claim 8, wherein said holding member comprises a hook portion for hooking over a support structure.

14. A portable baby change apparatus according to claim 8, wherein said holding member comprises a clamping member for clamping to a support structure.

15. A portable baby change apparatus according to claim 8, wherein said first part further comprises a compartment for storing the flexible attachment portion.

16. A portable baby change apparatus according to claim 1, wherein the portable baby change apparatus further comprises restraining means for limiting the angle through which the first and second parts pivot relative to one another.

17. A portable baby change apparatus according to claim 16, wherein said restraining means comprises at least one restraining member connecting said first part to said second part.

18. A portable baby change apparatus according to claim 16, wherein said first and second members are coupled by a hinge having a limited pivoting angle.

19. A portable baby change apparatus according to claim 1, wherein said first part comprises at least one pocket, arranged to be adjacent to said surface in the closed configuration.

20. A portable baby change apparatus according to claim 1, wherein, in the closed configuration, said first and second parts are joinable along at least a portion of their edges to form an enclosure.

21. A portable baby change apparatus according to claim 1, wherein said first and/or second part further comprises at least one compartment.

22. A portable baby change apparatus, comprising:

a first part, adapted to be removably suspended from a support structure;

a second part, pivotably attached to the first part, and providing at least a portion of a surface for changing a baby;

wherein the first and second parts are pivotable relative to each other, between a closed configuration wherein the first part covers said portion of said surface, and an open configuration wherein, when the first part is suspended from a support structure, said surface is substantially horizontal; and wherein the portable baby change apparatus further comprises a handle or strap attached to said first and/or second part such that, when the baby change apparatus is suspended by the handle or strap in the closed configuration, said first and second parts are pivotably attached at a lower edge.

23. A portable baby change apparatus, comprising:

a first part, adapted to be removably suspended from a support structure;

a second part, pivotably attached to the first part, and providing at least a portion of a surface for changing a baby;

wherein the first and second parts are pivotable relative to each other, between a closed configuration wherein the first part covers said portion of said surface, and an open configuration wherein, when the first part is suspended from a support structure, said surface is substantially horizontal; and wherein the first and second parts each comprises a fabric cover, wherein the fabric cover of the first part is attached to the fabric cover of the second part along one edge, enabling the first and second parts to pivot relative to one another.

* * * * *